United States Patent [19]

La Tour, Jr.

[11] 4,103,366

[45] Aug. 1, 1978

[54] REPLACEMENT VALVE ASSEMBLY FOR FLUSH TANK TOILETS

[76] Inventor: John La Tour, Jr., 124 Emmett St., Daytona Beach, Fla. 32014

[21] Appl. No.: 721,246

[22] Filed: Sep. 8, 1976

[51] Int. Cl.[2] ..... E03D 1/34; F16B 7/10

[52] U.S. Cl. ..... 4/393; 248/354 P; 403/109

[58] Field of Search ..... 4/52, 56, 57 P, 57 R; 403/109, 321-323, 343; 248/354 P

[56] References Cited

U.S. PATENT DOCUMENTS

| | | | |
|---|---|---|---|
| 2,629,879 | 3/1953 | Bennett | 4/57 P |
| 2,887,690 | 5/1959 | Hudkins | 4/57 P |
| 2,992,806 | 7/1961 | Kanter et al. | 4/57 P |
| 3,103,668 | 9/1963 | Smith | 4/57 P |
| 3,599,247 | 8/1971 | Kamphausen | 4/57 P |

*Primary Examiner*—Richard E. Aegerter

*Assistant Examiner*—Stuart S. Levy

*Attorney, Agent, or Firm*—Beveridge, DeGrandi, Kline & Lunsford

[57] ABSTRACT

This invention relates a replacement valve assembly for flush tank toilets of the type having a vertical discharge pipe connected within the tank with a generally horizontal annular valve seat. The replacement valve comprises a disc shaped member of rubber-like plastic material which is pivotally mounted on pins carried by a flexible annular ring which is in turn frictionally slidably mounted on a vertical post to provide the proper vertical position for the replacement valve disc. The vertical post is in turn secured to a horizontal extendable tube including at least two threaded parts which are rotated relative to each other to force the ends of the extendable tube into wedging engagement with the sidewalls of the flush tank.

1 Claim, 8 Drawing Figures

REPLACEMENT VALVE ASSEMBLY FOR FLUSH TANK TOILETS

BACKGROUND OF THE INVENTION

It is well known that the flushing mechanism of an ordinary household flush toilet is normally a very durable and long lasting assemblage. Hence, when the valve of such mechanism wears out, it is difficult for a householder to find an exact replacement because his particular mechanism may have been produced by a manufacturer who went out of business many years before. Additionally, in recent times there is a substantial interest on the part of many environmentally minded householders to conserve as much water as possible, and flush tank valve mechanisms have been developed which permit adjustable reduction of the amount of water consumed with each flushing of the tank. Such mechanism may, for example, comprise that disclosed in U.S. Pat. No. 2629879 Bennett wherein a ball-like float is slidably adjustably mounted on the trip line which extends from a pivotally movable valve disc to the trip lever and effectively prevents the discharge of the entire contents of the flush tank depending upon the vertical position of the float relative to the bottom of the tank.

There is the additional factor that to call a plumber to replace the flush valve mechanism of a toilet involves a very substantial expenditure for the average householder; hence there is a definite need for a replacement valve assembly that the average householder may quickly and conveniently install in his tank regardless of the type of mechanism that was previously employed and without requiring special tools for the installation.

OBJECTS OF THE INVENTION

Accordingly, it is an object of this invention to provide an improved replacement valve assembly for flush tank toilets of the type having a generally horizontally disposed valve seat located within the tank at the top of the discharge pipe.

A particular object of the invention is to provide a replacement flush tank valve assembly which utilizes a pivotally mounted valve disc of rubber-like plastic material which may be conveniently positioned relative to the generally horizontally disposed valve seat of the discharge pipe by a unique adaptor assembly, which, in turn, may be fixedly mounted within the flush tank by utilizing the wedging engagement of an expandable supporting tube with the sidewalls of the flush tank.

Other objects and advantages of this invention will become apparent to those skilled in the art from the following detailed description taken in conjunction with the annexed sheets of drawings.

DESCRIPTION OF THE INVENTION

Figure 1:
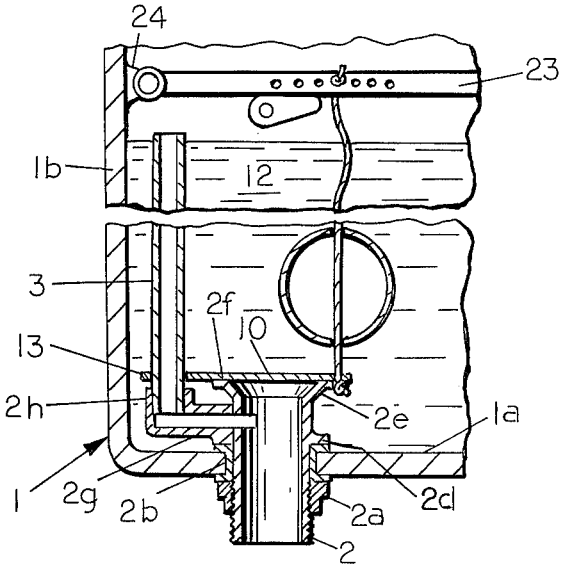
FIG. 1 PRIOR ART
FIG. 1 is a partial vertical sectional view showing a conventional type of flush tank valve mechanism, such as illustrated in U.S. Pat. No. 2629879 to Bennett.

Referring to FIG. 1, which has already been mentioned as being exemplary of the prior art, a flush tank 1 is shown in vertical section having a bottom wall 1*a* and sidewalls 1*b*. Bottom wall 1*a* is suitably apertured to receive the top end of a discharge pipe fitting 2 therein which is secured in sealing relationship to the bottom wall by a threaded nut 2*a* and an annular U-shaped gasekt 2*b* which is squeezed around the bottom wall 1*a* between an integral flange 2*d* provided on fitting 2 and the threaded nut 2*a*. The top end of fitting 2 is outwardly flared as at 2*e* to provide a generally horizontal valve seat 2*f*. Fitting 2 is further provided with an integral lateral extension 2*g* terminating in an upstanding elbow portion 2*h* in which is mounted an overflow pipe 3.

The overflow pipe 3 is utilized to mount a flat valve 10 formed of rubber-like material and having a lateral extension 13 defining a hole which snugly engages the periphery of overflow pipe 3. Valve 10 is thus positioned in closing relationship with respect to the horizontal seating surface 2*f* and can be deformed and raised out of its sealing engagement with such surface by the action of a pull line 12 which is connected in conventional fashion to a trip lever 23 which is pivotally mounted to an appropriate bearing 24 provided on the sidewall 1*b* of the tank 1.

At an intermediate position on the trip line 12, a float 11, comprising a spherical mass of cellular material, or a rubber ball substantially lighter than water, is mounted in frictional engagement with the line 12 so that it will maintain a desired selected position above the connection of the trip line 12 to the outer extremity of the valve 10.

With this arrangement, as is described in U.S. Pat. No. 2629879 to Bennett, the amount of water remaining in the tank during a flushing may be pre-determined by the selection of the vertical position of the float 11 relative to the valve 10 and substantial conservation of flushing water can be achieved.

When it is desired to employ a valve assemblage of the type generally shown in FIG. 1 in toilets equipped with other types of valves, such as the more conventional hollow rubber ball valve, it would, prior to the advent of this invention, have required substantial modification of the interior of the flush tank and probably the services of the plumber to effect such change.

Figure 2:
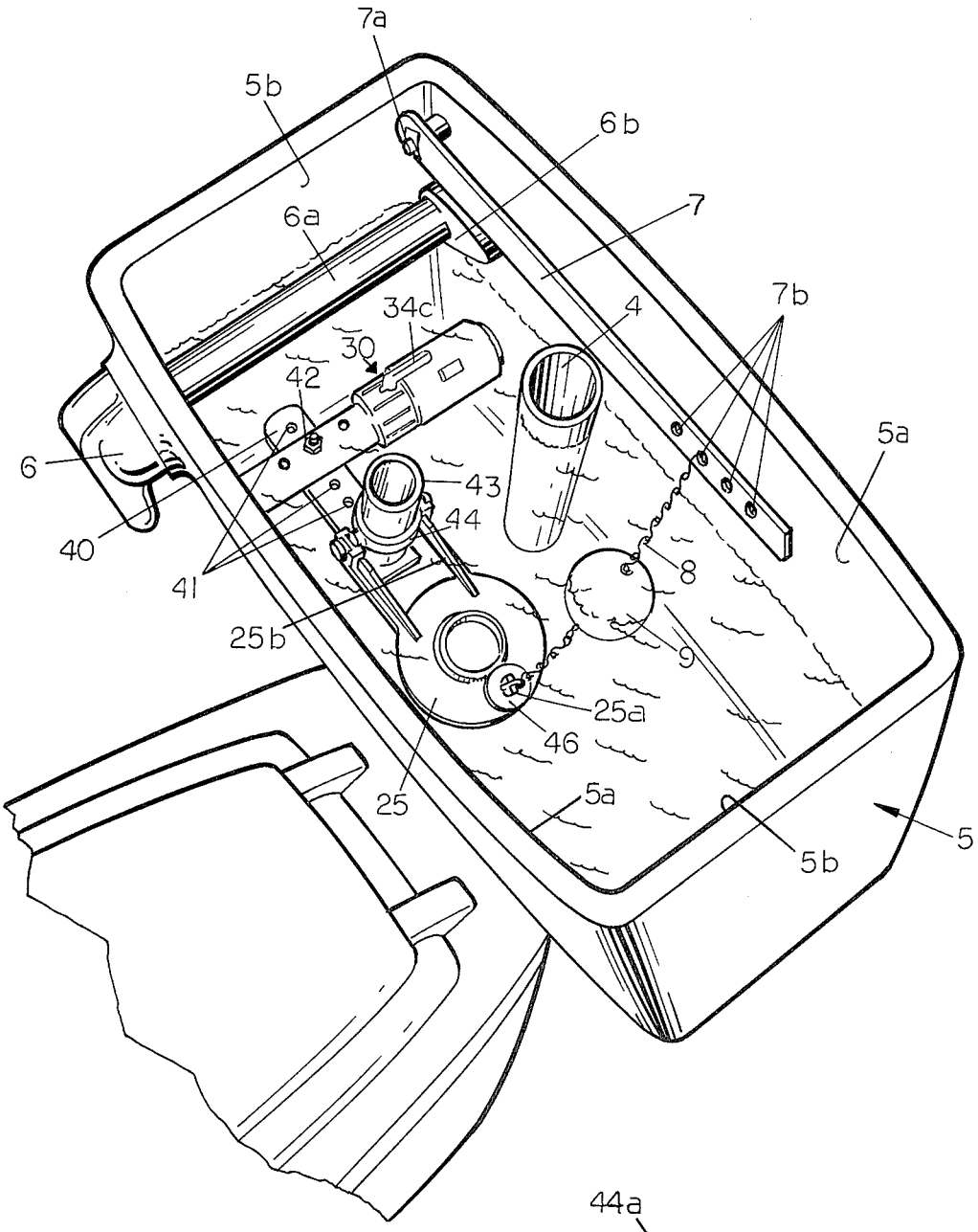
FIG. 2 is a perspective view of a flush tank with a replacement valve assembly embodying this invention mounted therein.

Accordingly, in FIG. 2 there is shown a valve assemblage embodying this invention which may be conveniently mounted in any flush tank without requiring special tools. The only limitation is that the discharge pipe must have a generally horizontally disposed, upwardly facing valve seat (which is shown in FIG. 3).

The tank 5 shown in FIG. 2 has opposed sidewalls 5*a* and opposed endwalls 5*b*. A discharge pipe fitting 2 (FIG. 3) is mounted in the bottom of tank 5 and an overflow pipe 4 is provided. A conventional flushing mechanism is provided, comprising a handle 6 mounted exteriorly of the tank on a pivot rod 6*a* which in turn supports a trip cam 6*b*. Trip cam 6*b* engages a flush lever 7 which is pivotally mounted at one end by a bolt 7*a* to the sidewall 5*a* of the tank and the other end is provided with a plurality of spaced apertures 7*b* to which a trip chain or line 8 may be selectively secured. The other end of chain 8 is connected to an upstanding protuberance 25*a* provided on a disc shaped valve 25 which is formed of a rubber-like plastic material, such as low density polyethelyne, and normally has a density lighter than of water. If water conservation is desired, a cellular ball 9 may be adjustably mounted on the trip chain 8.

Figure 5:
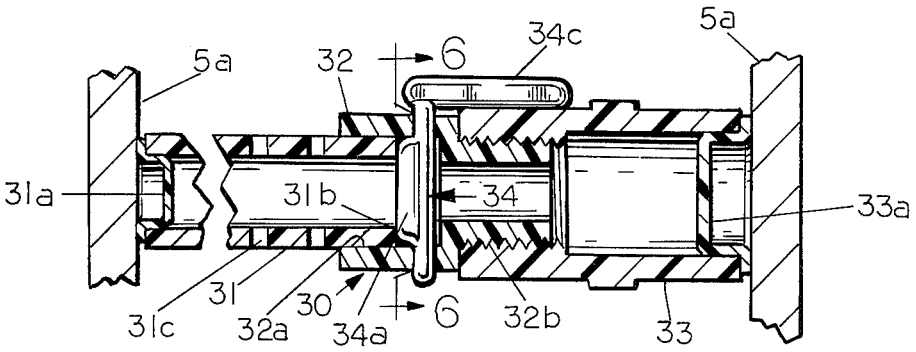
FIG. 5 is a vertical sectional view taken on the plane 5—5 of FIG. 4.
Figure 3:
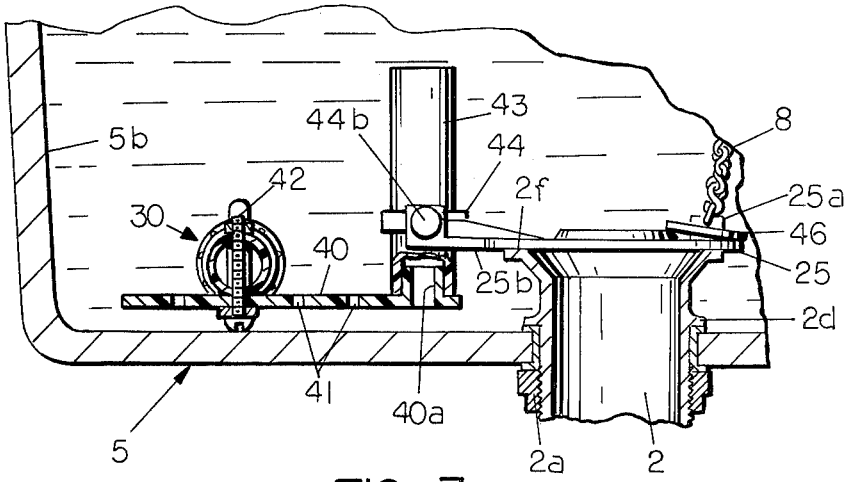
FIG. 3 is a partial vertical sectional view of the valve mounting mechanism of FIG. 2.

Referring now to FIGS. 2 and 3, the pivotal mounting of the disc shaped valve 25 in proper overlying relationship to the horizontal valve seating surface 2*f* of the discharge fitting 2 is accomplished by a unique adaptor mechanism. The adaptor mechanism comprises an extendable assemblage 30 which is mounted in wedging relationship between the opposed sidewalls 5*a* of the tank 5. Referring particularly to FIG. 5, it will be seen that the assemblage 30 comprises a relatively short length of rigid vinyl tubing 31 having a soft plastic end cap 31*a* inserted in its one end and providing for frictional and sealing engagement with the tank sidewall 5*a*. The other end 31*b* of tubing 31 is slidably inserted in a rigid vinyl reducing coupling 32, having a smooth bored large end 32*a* receiving tubing 31 and an externally threaded smaller end 32*b*. The threaded portion 32*b* is in turn threadably engaged with an interiorly threaded rigid vinyl tube 33 which projects the remainder of the way across the space between the tank sidewalls 5*a* and has a relatively soft plastic end cap 33*a* inserted in its end to provide frictional sealing engagement with the adjacent sidewall 5*a*.

Figure 6:
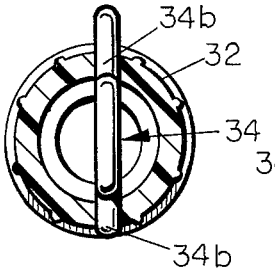
FIG. 6 is a vertical, sectional view taken on the plane 6—6 of FIG. 5.
Figure 7:
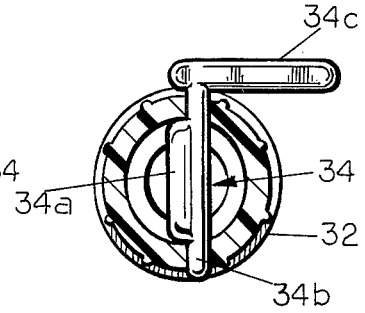
FIG. 7 is a view similar to FIG. 6 but showing the clamping member in its inoperative position.

Immediately adjacent the inserted end 31*b* of the tube 31, a transverse wedging member 34 of relatively rigid plastic is provided having an eccentrically shaped center portion 34*a* and pivot end portions 34*b* traversing appropriately shaped apertures in the wall of the reducing coupling 32. An integral extension 34*c* provides a convenient handle for rotating the wedging member 34 from the position shown in FIG. 7 wherein it occupies minimum axial space within the assemblage 30 to the position shown in FIG. 6 where it forcibly moves the tube 31 axially outwardly relative to the reducing coupling 32.

To assemble the expandable assemblage 30 in any tank 5, the vinyl tube 30 is cut to a length so that when the expandable assemblage 30 is positioned within the tank, the opposed ends thereof can be brought into wedging engagement with the tank sidewalls by rotation of the internally threaded sleeve 33 relative to the externally threaded portion 32*b* of the reducing coupling 32. When snug engagement of the expandable tubing assemblage 30 is achieved with the sidewalls 5*a*, the wedging member 34 is then rotated 90° from the position shown in FIG. 7, in which it rests during the initial assembly operation, to the position shown in FIG. 6 wherein it exerts an outward displacement of the vinyl tube 31 relative to the rest of the assemblage and thus achieves a wedged locking of the expandable assemblage 30 at any selected position within the tank 5.

A bar element 40 is provided having a plurality of holes 41 formed therein, one of which is selected to mount the bar 40 to the expandable tube assemblage 30 by means of a transverse bolt and nut 42. Tube 31 is provided with a plurality of axially spaced holes 31*c* to selectively receive bolt 42. It is thus apparent that the lateral position of the bar 40 may be selectively varied according to which ones of the holes 41 and 31*c* are selected for the mounting of the bar 40.

Figure 8:
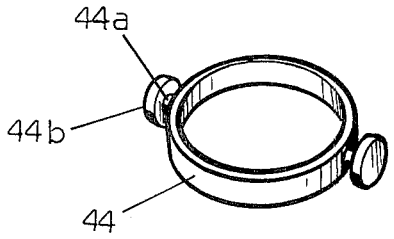
FIG. 8 is a perspective view of the valve pivot ring.

Preferably, the bar 40 is mounted in a position as close to the bottom of the tank as possible as illustrated in FIG. 3. On one end of bar 40 there is provided an integral upstanding tubular extension 40*a* to which is rigidly secured an upstanding vinyl tube or post 43. The rigid connection between protuberance 40*a* and tube 43 may be press fit, or adhesive may be employed to effect the rigid assemblage thereof. The tube 43 provides a frictionally slidable mounting post for a pivot ring 44 which is formed of relatively resilient plastic material, such as high density polyethelyne, and it is provided with a pair of opposed radial pivot pins 44*a* (FIG. 8) each terminating in an enlarged cap portion 44*b*. The rubber-like valve disc 25 is provided with a pair of integral parallel extensions 25*b*, each of which is apertured at its free end to snap over the retaining caps 44*b* provided on the pivot pins 44*a* and thereby pivotally mount the valve 25 for movement about a generally horizontal axis.

From the aforegoing, it is clear that the position of the valve 25 relative to the horizontal valve seat 2*f* may be conveniently adjusted so that the valve disc 25 is in an essentially horizontal overlying position relative to valve seat 2*f*. The flexibility of positioning of the expandable tube assemblage 30 in tank 5, coupled with the adjustable positioning of the support bar 40, plus the slidable positioning of the pivot ring 44 on the post 43 permits precise adjustment of the position of valve 25 to exactly overlie the horizontal valve seat 2*f* in sealing relationship thereto.

Figure 4:
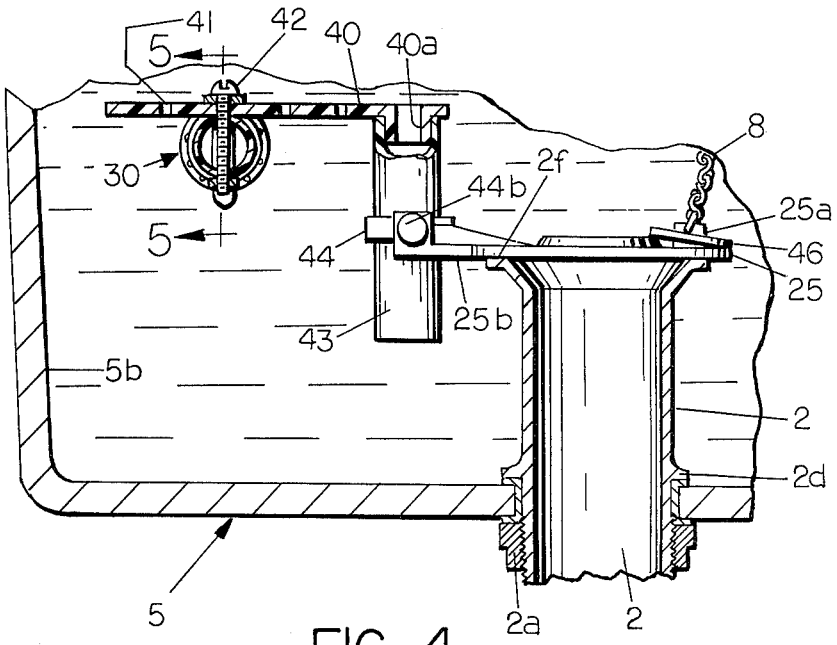
FIG. 4 is a view similar to FIG. 3 but showing an alternative mounting of the valve supporting post within the flush tank.

In some tanks, interior contours or the remnants of the valve mechanism being replaced may prevent the mounting of the assemblage in the manner shown in FIG. 3 with the support bar 40 adjacent the bottom of the tank. In such event, the bar 40 may be mounted in an elevated position relative to the bottom of the tank in the manner illustrated in FIG. 4. In this position, the support post 43 depends from the support bar 40 and again the pivotal mounting for the valve disc 25 may be readily adjusted so that the valve will exactly overlie the horizontal valve seat 2*f*.

Because of the fact that the thermoplastic material from which the disc valve 25 is preferably formed is lighter than water, it may be necessary to apply some weight to the valve 25 to insure that it will snap into closed position when the desired amount of water has been flushed out of the tank. Such additional weight may be conveniently added in the form of a metal washer 46 which surrounds the upstanding protuberance 25*a* formed on the valve, and is secured thereto by the pull chain or line 8.

From the foregoing description it should be apparent to those skilled in the art that this invention provides a replacement valve assemblage for all types of flush tanks having a generally horizontally disposed valve seat. The mounting provided for such valve assemblage is so flexible that the valve may be properly positioned relative to the valve seat regardless of the configuration of the tank and the existence of other members within the tank such as portions of the valve mechanism being replaced. More importantly, the entire assembly operation can be accomplished without the use of tools and certainly without requiring the services of a plumber.

While I have described a preferred embodiment, modifications of the invention will be readily apparent to those skilled in the art and I intend that the scope of the invention be defined solely by the appended claims.

I claim:

1. A replacement flush valve assembly for a toilet having a flush tank which has generally parallel, spaced vertical side walls, vertical end walls and a bottom and a discharge pipe protruding upwardly through the bottom with an annular, planar seat on its upper end, said assembly comprising:

(a) a flapper valve adapted to sealingly fit over said seat, said valve having
  (1) a disc-like body and
  (2) spaced apart pivot arms extending outwardly from said body, (b) and means for mounting said valve member for angular movement between a raised position spaced above said seat and a closed position sealingly overlying said seat, said mounting means comprising
  (1) an axially extendible support adapted to be positioned horizontally in said tank with its ends tightly engaging said side walls, said support having a plurality of axially spaced apertures extending therethrough
  (2) means for locking said support in its extended position with the apertures extending generally vertically,
  (3) an elongated support bar having a plurality of longitudinally spaced apertures,
  (4) a post extending upwardly of said bar,
  (5) a resilient ring adapted to embrace said post frictionally for slidable movement therealong, said ring having radially protruding pivots adapted for pivotal engagement with the free ends of said valve pivot arms, and
  (6) a fastener adapted to extend through a selected pair of the apertures in said support and in said bar for fastening said bar to said support at a position in which said bar extends laterally from said support toward said discharge pipe seat with said post extending vertically relative to said support bar to place said flapper valve in a position overlying said seat, said extendible support comprising first and second telescoping tubular elements having mutually engageable threaded portions, a rod adapted to be inserted into the open end of the second of said tubular elements, and compressable friction pads at the outer ends of the first of said tubular elements and said rod, said support locking means comprising a pin having a radially extending projection on its medial portion and adapted to extend through diametrically aligned apertures in the wall of the second of said tubular elements adjacent the inner end of said rod for rotation between a locked position with said projecting medial portion in engagement with the inner end of said rod thrusting said rod axially to tightly lock said support in position and an unlocked position with the pin rotated out of disengagement with said rod.

* * * * *